United States Patent [19]

Shaw

[11] 4,169,458

[45] Oct. 2, 1979

[54] ZERO CLEARANCE FIREPLACE TYPE HEATING DEVICE

[75] Inventor: William S. Shaw, Prince George, Canada

[73] Assignee: Shaw's Modular Fireplaces, Ltd., Prince George, Canada

[21] Appl. No.: 831,823

[22] Filed: Sep. 9, 1977

[30] Foreign Application Priority Data

May 6, 1977 [CA] Canada ..... 277866

[51] Int. Cl.[2] ..... F24B 1/18

[52] U.S. Cl. ..... 126/120; 126/121

[58] Field of Search ..... 126/120, 121, 135, 136, 126/140, 141, 142, 131, 143

[56] References Cited

U.S. PATENT DOCUMENTS

| | | | |
|---|---|---|---|
| 2,703,566 | 3/1955 | Fogel et al. | 126/120 |
| 3,190,281 | 6/1965 | Northwood | 126/120 |
| 3,664,325 | 5/1972 | Malafouris | 126/121 |
| 4,010,728 | 3/1977 | Hempel et al. | 126/121 X |
| 4,015,581 | 4/1977 | Martenson | 126/121 |
| 4,042,160 | 8/1977 | Ickes | 126/121 |
| 4,074,679 | 2/1978 | Jensen | 126/131 X |

*Primary Examiner*—Dennis L. Taylor

*Attorney, Agent, or Firm*—LeBlanc & Shur

[57] ABSTRACT

An efficient zero clearance fireplace heating device is disclosed. The device includes a conventional metal firebox having closeable glass doors and a flue adapted to communicate with a chimney. The sides and bottom of the firebox are enclosed with mutually spaced metal walls to form a plurality of interconnected chambers for circulating either room air or outside air therethrough. A portion of the circulated air is returned to the room through a vent and a portion is admitted to the firebox for combustion air. The combustion air is initially directed across the interior surface of the glass doors to minimize blackening thereof by smoke from the fire. Baffles may be provided between walls of the interconnected chambers to provide a labyrinthian series of passages for air circulated therethrough whereby heat is exchanged between the walls and the circulating air so that the outside surfaces of the device remain sufficiently cool to permit installation adjacent combustible structural members.

6 Claims, 6 Drawing Figures

ZERO CLEARANCE FIREPLACE TYPE HEATING DEVICE

This invention relates to zero clearance fireplace units which are preferred for installation in existing structures, but may also be installed in new construction to provide both an efficient and an aesthetically pleasing heating unit. Specifically, this invention relates to a fireplace unit which utilizes a plurality of mutually spaced shells or skins to define heat exchange passages surrounding the sides and rear and bottom of the firebox whereby outside or room air circulated therethrough is heated and ultimately directed into the room to heat the room while maintaining the external surface of the unit at a safe temperature.

The fireplace unit of this invention then may be installed in an existing home or mobile home without a special foundation, fire wall, or insulating structure. The device of this invention combines the aesthetic appeal of a decorative fireplace in an efficient, safe heating means utilizing fuel in an abundant supply such as wood or coal.

With the increasing costs of natural gas, and home heating oil, reliance on a supplemental heating means, or use of an alternate fuel source has become important. Wood and coal are abundant natural resources suited for use as a supplement or alternate fuel source in homes. However, an efficient heating unit to consume such fuels is also needed. While these fuels could be consumed in the conventional fireplace, as is well known, use of a conventional fireplace as a supplemental heating unit may result in an overall energy loss from the structure. A conventional fireplace provides radiant heat immediately in front thereof, but does not supply convection currents needed to circulate warm air in the room. Therefore, a conventional fireplace is an extremely inefficient means for consuming fuel. In addition, unless the damper is closed when the fireplace is not in use, the primary heating source will be called upon to make up the heat lost up the chimney after the fire has burnt out.

Furthermore, a conventional fireplace will create a pressure differential between the interior and the exterior of a heated structure. This pressure differential will lead to excessive heat loss through cracks around windows and doors and the like.

Therefore, a conventional fireplace, while demonstrating a decorative warmth, actually consumes fuel but only marginally assists in heating a structure, and in fact, may account for an overall heat loss.

The prior art contains many attempts to render the conventional fireplace, a highly inefficient heating means, more efficient. In order to avoid loss of heat up the chimney without losing the decorative affect, glass doors have been used to cover the firebox opening. Combustion air is provided through vent openings located below the doors which openings may be closed when the fireplace is not in use. By utilizing glass doors then it becomes unnecessary to close the damper at night, and loss of ambient heat up the chimney may be remedied by merely closing the vents located below the doors. Unfortunately, in use, the interior surfaces of these glass doors tend to become smoke blackened. Conventional glass doors then diminish the radiant heat transmitted to the room, and require frequent cleaning. In addition, the user, to avoid heat loss up the chimney must remember to close the vents when the fireplace is not in use. If the vents are not closed ambient air will continue to escape up the chimney through the open damper.

As noted above, when a fireplace is in use heat loss is also fostered by the use of room air for combustion air. The use of room air creates a situation where an underpressure is maintained within the structure. This underpressure facilitates heat loss through cracks and around doors and windows. In the aforementioned case, glass doors will not minimize this underpressure situation because room air is utilized as combustion air for the fire.

In order to make fireplaces efficient heaters it has been proposed to circulate either room air or outside air in ducts around the firebox with a return flow into the room. Circulation of heated, outside air into the room acts to repressurize the interior of a structure against heat loss through cracks. However, the duct work necessary adds considerably to the space requirement for such a fireplace if the unit is constructed of bricks of masonry and the space required and weight militates against use except in new construction. In other words, unless the room or living area is designed to accommodate a massive structure, most homes would not provide sufficient area or space to accommodate such units. See, for example, U.S. Pat. No. 1,588,587.

In order to avoid the massive size of such fireplace units constructed of bricks or masonry, it is known to provide fireplace units constructed of metal which can be accommodated in existing structures as free standing units on fire-resistant foundations in much smaller space. See, for example, U.S. Pat. No. 3,926,174. It is also known to provide metal fireplaces having surrounding duct work so that room air or outside air may be circulated around the firebox to heat the air, which is then expelled into the room. The heated air returned to the room, therefore, more efficiently utilizes the energy produced by combustion.

However, to comply with safety regulations these prior units have often required additional installation or construction of an adjacent fire wall if the device is mounted beside a structural wall. The heat conducting sides and base become extremely hot when fuel is burned in the firebox.

In the alternative, the unit must be spaced a substantial distance from combustible structural members and from the floor of the dwelling, or must be constructed externally to the dwelling.

Spacing the unit away from structural walls is often undesirable because of the restrictions placed thereby on available living area. In addition, special insulating features external to the heating unit also increase costs and decrease the aesthetic appeal.

Constructing a fireplace unit external to the dwelling as, for example, in U.S. Pat. No. 3,049,113, would require a masonry facade and, in addition, could require insulation. The facade is necessary to insulate the metal unit as well as to improve the outward appearance of the structure. The masonry facade increases the mass of the construction and the costs thereof, and for this reason is undesirable.

It has been discovered, however, that a safe and efficient zero clearance unit may be constructed according to this invention to maximize the heat generated by combustion in a metal fireplace heating unit. The device of this invention utilizes a conventional metal firebox and flue. The device circulates outside air, preferably, or inside air if desired, through a plurality of chambers, each of which surrounds the sides, bottom, and rear of the firebox. In one embodiment of this invention an additional chamber is provided surrounding the aforementioned chambers which provides a dead air insulating space.

Glass doors are provided on the opening of the firebox whereby room air will not be admitted as combustion air through the firebox opening. Instead, the air circulated within the chambers is heated, and a portion thereof directed across the interior surface of the glass doors and into the firebox to serve as combustion air. The remaining heated air is directed into the room through a vent disposed over the firebox. A damper is disposed below the firebox which selectively admits, as desired, room air or outside air into the unit. If outside air is admitted into the unit, the outside air is circulated successively through the chambers, heated, and a portion directed into the firebox as combustion air, with the remaining air directed into the room to pressurize the room and create convection currents for efficient heating thereof.

The circulation pattern through the successive chambers move the air around the firebox and upwardly through an outer chamber, which air is then circulated downwardly through the next inner chamber, in this pattern until the innermost chamber is reached. Diversion vents then direct a portion of the air in the innermost chamber into the firebox, with the remaining air directed outwardly through the vent aforementioned. In addition to circulating air through the chambers, angled baffles may be disposed within each chamber between opposing walls thereof to provide a labyrinthian series of passageways to slow air circulation and improve heat transfer between the walls thereof and the air current.

It has been discovered that the unit of this invention may be mounted in a structural wall or against a structural wall as desired because the external surface thereof is sufficiently cool to comply with safety regulations even though the unit is constructed of metal. The circulating air through the labyrinthian passages acts as a heat exchange medium to cool the walls of the chambers whereby the heat generated in the firebox is effectively transferred to the circulating air and ultimately into the room as convection currents from the unit vent.

Accordingly, it is an object of this invention to provide a safe and efficient heating unit which may be installed in existing structures as a zero clearance unit.

It is another object to provide a fireplace heating device which will efficiently utilize the heat generated by solid fuel consumed therein to create convection currents within a room and pressurize the room.

It is another object of this invention to provide a fireplace heating unit which utilizes heated outside air as combustion air in the fireplace so that heated room air will not be withdrawn from the structure and expelled through the flue.

It is still another object of this invention to provide a fireplace heating unit which may be installed in mobile homes, or existing homes which is relatively light in weight, constructed of metal, and a safe and efficient means for utilizing the heat generated therein to heat the structure.

These and other objects will become readily apparent with reference to the drawings and following descriptions wherein FIG. 1 is a fragmentary, side view in longitudinal section of an embodiment of this invention.

Figure 2:
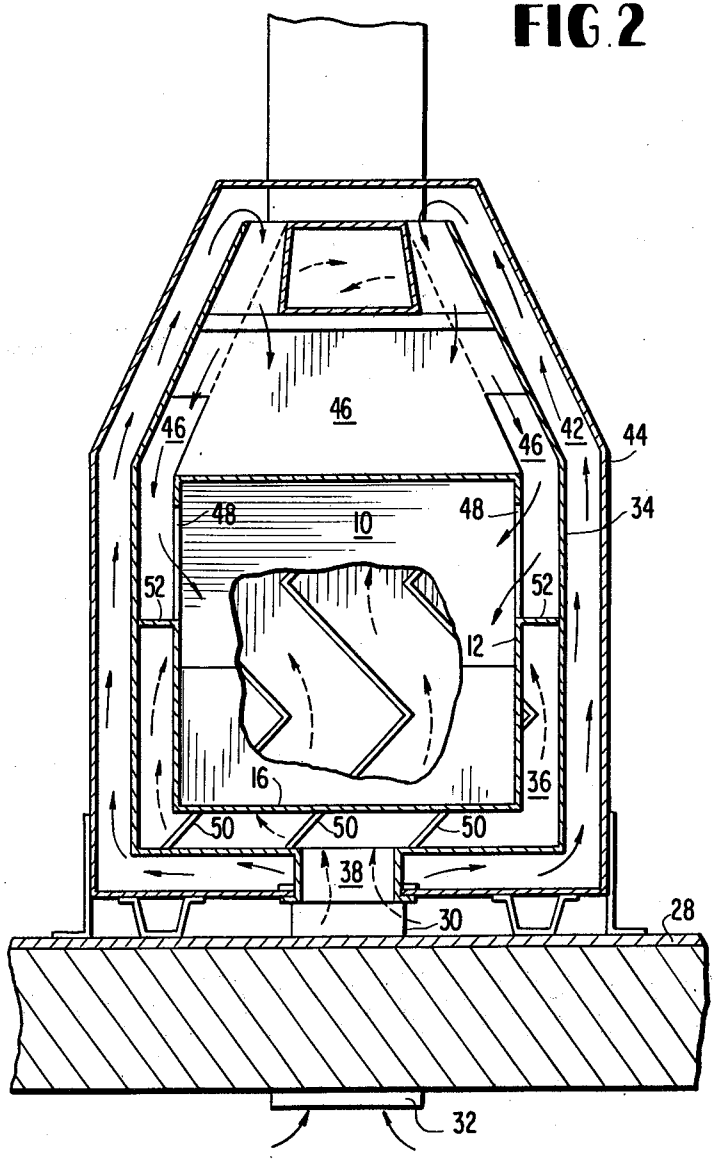
FIG. 2 is a fragmentary front view in longitudinal section of the device of FIG. 1.
Figure 1:
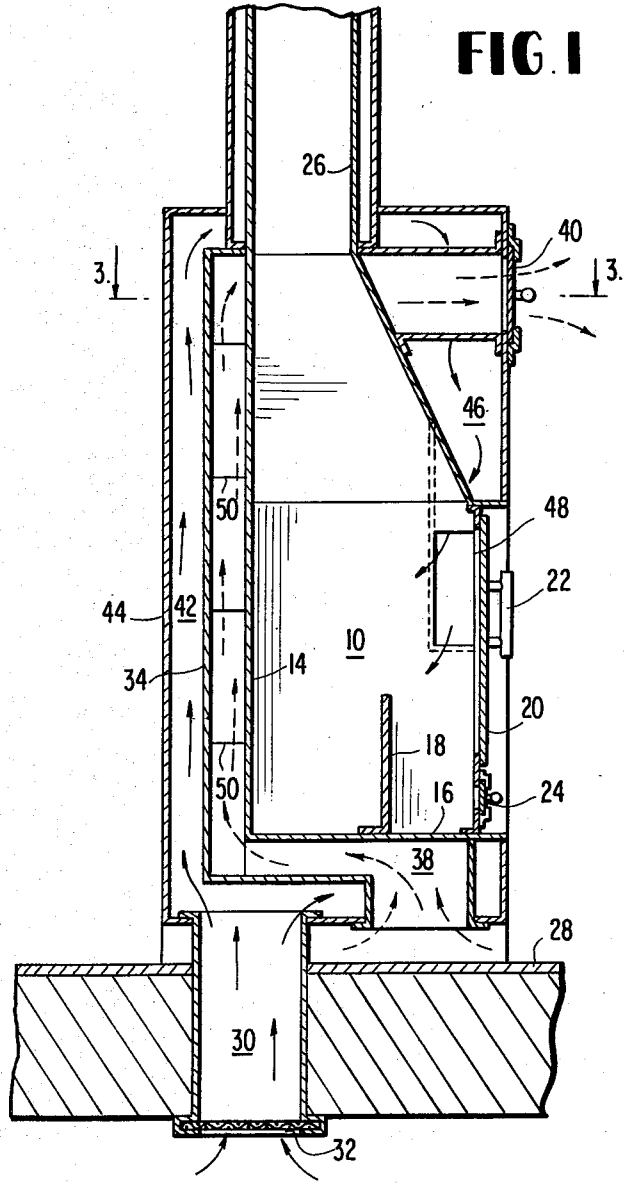

With attention to the drawings and to FIGS. 1 and 2, in particular, FIGS. 1 and 2 depict one embodiment of the device of this invention. The device includes a firebox 10 which may be constructed preferably of 14 gauge number 304 stainless steel. The firebox 10 includes opposed sides 12 and a back 14. The base 16 of the firebox may mount a steel fret 18 to retain firelogs, or in the alternative a conventional grate or andirons may be used (not shown) as desired. A forward portion of box 10 mounts glass doors 20 which are conventional in design and are opened and closed by handles 22. Conventional vents 24 are shown in FIG. 1 disposed below doors 20 to admit room air to the firebox 10 for combustion. However, as will be described hereinafter these vents would remain closed during normal usage of this device. Smoke from a fire in firebox 10 is expelled through flue 26 in the conventional fashion. Flue 26 may be a chimney, or a pipe surrounded by a chimney facade, as desired.

The device of this invention is intended to be mounted on a floor 28. If the device is installed in, for example, a mobile home, outside air inlet 30 will be provided through floor 28. In this event, the outside air inlet portion of inlet 30 should be covered with a screen 32. As will be obvious to those skilled in the art, if the device is mounted in a home with a basement, inlet 30 may be extended through an outside wall.

Firebox 10 is surrounded by a first shell or skin 34 to form a first chamber between the exterior of the firebox and said shell. The shell 32 may be constructed of, for example, 28 gauge galvanized steel. The first chamber 36 circulates room air admitted through room air inlet 38 around firebox 10 exiting the unit at vent 40. In this way, room air is circulated around the firebox, heated, and expelled into the room through vent 40 to create convection currents within the room for more efficient heating. As will be obvious, some radiant heat will be provided through glass doors 20 as in a conventional fireplace.

Outside air is circulated through an outer chamber 42 formed by shell 44 which surrounds shell 34. Outside air is admitted to the unit through inlet 30, and circulated, as shown in FIGS. 1 and 2, through outer chamber 42 around the unit to forward chamber 46 disposed above and in front of the firebox and doors 20. Air from chamber 46 circulates downwardly through side vents 48 which direct a stream of said air across the interior surface of doors 20. The air directed through vents 48 serves dual purposes of washing the interior surface of doors 20 to minimize blackening thereof by smoke, and providing combustion air for the fire in firebox 10. Therefore, the combustion air for the unit of this invention is not supplied from the interior of the structure. Accordingly, use of the device of this invention does not act to depressurize the room. Furthermore, room air is not drawn into the flue when the instant device is not in use. As will be obvious to those skilled in the art, room air circulates through the device and returns to the room while outside air circulates through the device and into the firebox and exits through the flue. In FIGS. 1 and 2, dotted arrows represent room air while solid arrows represent outside air.

Finally, in order to maximize the heat exchange between the walls of the firebox 10 and the air circulating therethrough, angled baffle plates 50 are disposed within chamber 36 and extend in the path of travel of air circulating therethrough whereby the air will be forced to travel a labyrinthian series of passages to maximize residence time within the unit and therefore to maximize heat exchange between the walls and the air.

It will also be observed with reference to FIG. 2 that the chamber 46 is separated from chamber 36 by horizontal plates 52 disposed below vents 48.

Figure 3:
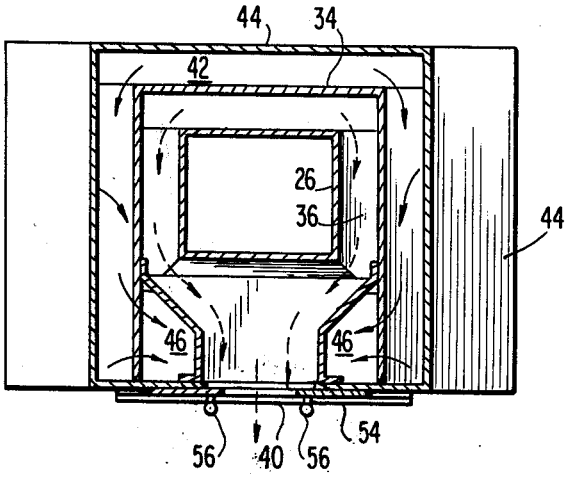
FIG. 3 is a cross sectional view taken along line 3—3 of FIG. 1.

With attention to FIG. 3, vent 40 may include louvers of 54 to direct the flow of air therethrough which are controlled by handles 56 and are generally of conventional design. As shown in FIG. 2, outside air in chamber 42 circulates around chamber 36, which in turn surrounds the flue 26. The outside air then enters chamber 46 for circulation into the firebox, and room air circulates around flue 26 in chamber 36 and exits into the outside room through vent 40.

Accordingly, this embodiment of the instant invention comprises a zero clearance unit which may safely be mounted in the wall of an existing home, or in a mobile home. The unit of this embodiment utilizes outside air as combustion air in the firebox, and directs said air across glass doors which are normally closed during use of the fireplace to sweep the interior surface thereof and to minimize blackening. Room air, on the other hand, circulates around the firebox in an interior chamber, preferably through baffle plates for heat exchange to thereby exit the unit into the room in hot convection currents. The air circulating through chambers 36 and 42, insulates the firebox 10 so that even though the walls thereof are metal, the exterior surface of the device of this invention will remain cool enough to be mounted abutting combustible structural members.

Figure 6:
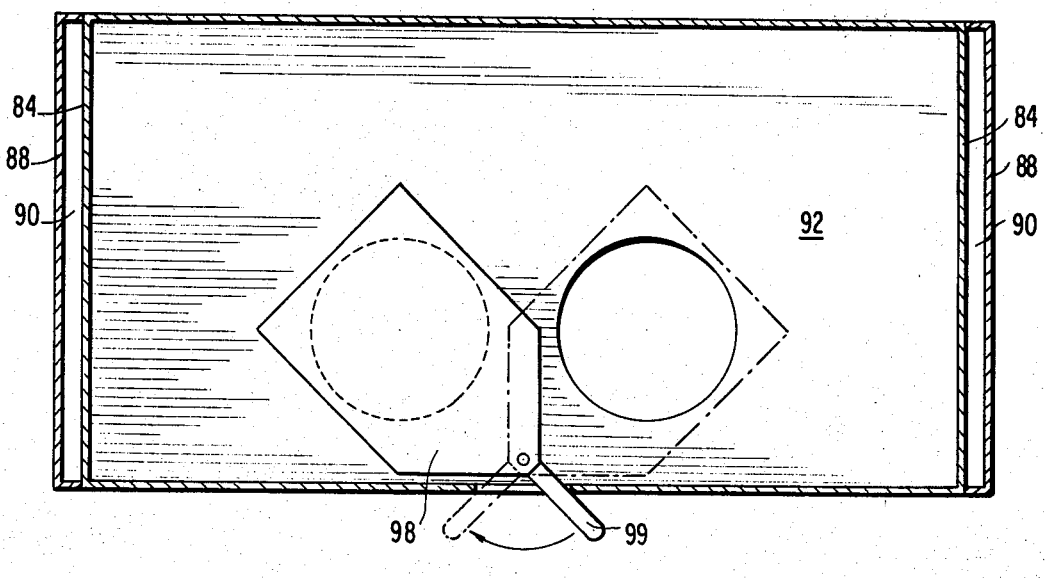
FIG. 6 is a cross sectional view taken along line 6—6 of FIG. 5.
Figure 5:
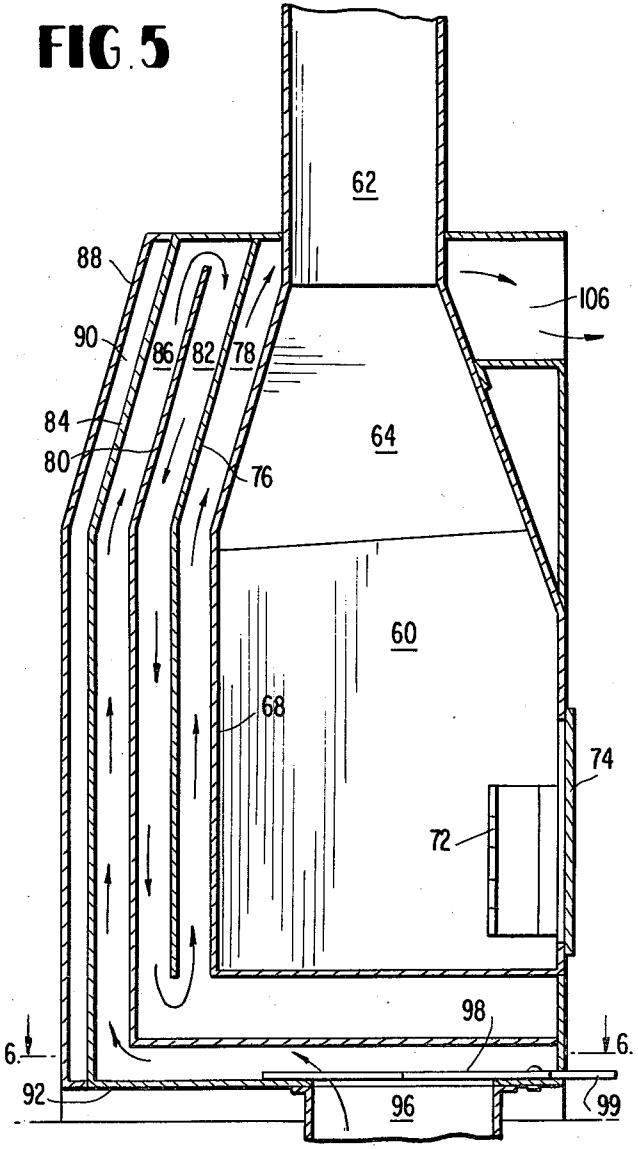
FIG. 5 is a fragmentary side view in longitudinal section of the embodiment of FIG. 4.
Figure 4:
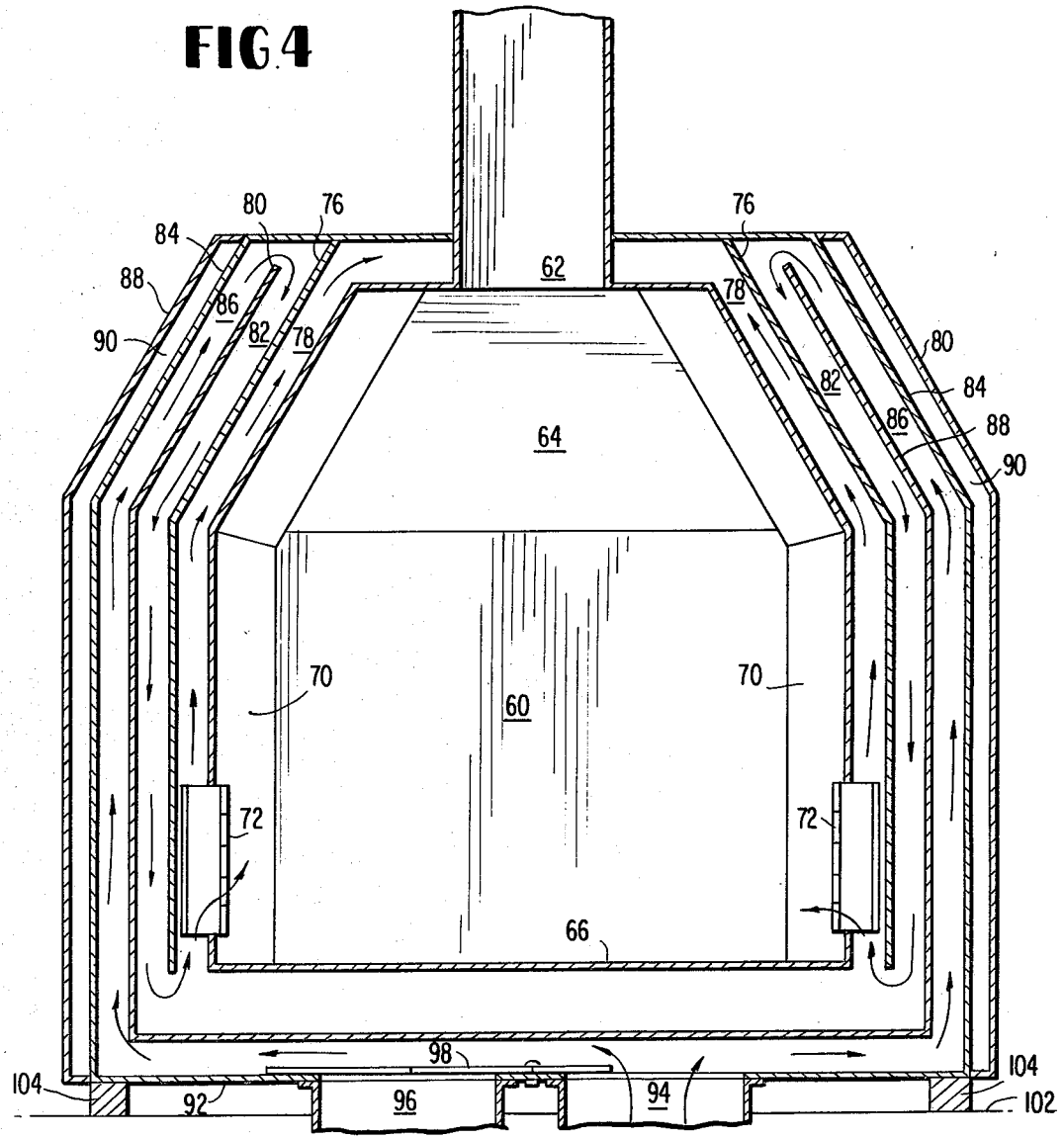
FIG. 4 is a fragmentary front view in longitudinal section of another embodiment of this invention.

With attention to FIGS. 4, 5 and 6, an alternate embodiment of this invention is depicted wherein a plurality of passageways are substituted for baffle plates 50 in FIGS. 1 and 2. In this embodiment, the firebox 60 communicates in the conventional fashion with a flue 62 through a hood 64. The firebox typically is constructed with bottom portion 66 and rear portion 68 of 14 gauge stainless steel while side portions 70 are constructed of 16 gauge stainless. In a preferred embodiment, the firebox may measure 24 inches across in the rear and 32 inches in front, and may be constructed with a depth of 16 inches to provide a fireplace of conventional dimensions.

Walls 70 include side vent deflectors 72. The firebox, as shown in FIG. 5, utilizes conventional glass doors 74 to close the front opening thereof. Deflectors 72 are intended to deflect combustion air across the interior surface of doors 74. The deflected air curtain passing across said surface is intended to minimize blackening of the surface by smoke from fire within the firebox.

Firebox 60 is surrounded by a first skin or shell 76 which defines with the exterior surface of the firebox a first chamber 78. Wall 76 is, in turn, surrounded by a second shell 80 which forms, with wall 76, a second chamber 82.

Wall 80 is, in turn, surrounded by a third shell 84 which forms with wall 80 a third chamber 86. Finally, wall 84 is surrounded by an outer shell 88 which forms a chamber 90 with wall 84.

The lower surface 92 is integral with the third shell 84. Lower wall 92 mounts alternate air inlets 94 and 96 which admit, respectively, room air or outside air. A swival door 98 is pivotally mounted thereover, and as shown in FIG. 6, an external handle 99 is provided. Outside air inlet 96 may extend through the floor as shown in FIGS. 1 and 2, or through an outside wall whereby outside air may be admitted directly into the third chamber 86. In the alternative, by moving handle 99, room air may be admitted from below the unit in the space created between the floor 102 and the lower surface of base 92. Spacer legs 104 may be provided to define this space.

As shown in FIGS. 4 and 5, chambers 78, 82 and 86 are innerconnected to provide a tortuous or labyrinthian passage for air admitted into the device. Accordingly, air admitted through the inlet in plate 92 travels upwardly through chamber 86, and downwardly through chamber 82. Air then passes upwardly through the innermost chamber 78, and a portion thereof is diverted into firebox 60 for combustion air. The remaining flow of air passes upwardly through chamber 68 to be expelled through outlet 106 into the surrounding room. Outlet 106 may be a louvered vent whereby the convection current of heated air may be directed in the conventional fashion to circulate throughout the room. By providing the labyrinthian series of passages, air is forced to act as a heat exchange medium and reduce the temperature of the metal walls 76, 80 and 84.

Finally, the outside chamber 90 is, in this embodiment, defined as a dead air space. It will be obvious to those skilled in the art, however, that air may be circulated through chamber 90 also, if desired.

This embodiment also may be modified to, for example, circulate air through chamber 90, and through one or more passages surrounding the flue 62, to provide a zero clearance flue (not shown). The device of this invention, however, has been found to be adaptable as a zero clearance unit for modifying existing homes, or for use in new construction. The unit, even though the walls are of metal, is sufficiently cool at its external surface to present no safety hazard when mounted abutting combustible structural members. A provision of a tortuous path for air to circulate around the box, whereby the air is used both as combustion air, and used to heat the surrounding room, maximizes heating efficiency. As in the embodiment of FIGS. 1–3, if outside air is admitted into the device, it will be heated, and a portion returned to the room to pressurize the room. If the glass doors are closed, outside air will circulate through the device and this flow of air may be shut off by a damper 98. Accordingly, if damper 98 is closed the fire in firebox 60 will no longer receive combustion air and will extinguish. If, in the alternative, the hot air outlet 106 is closed, outside air will merely circulate through the device into the firebox, and exit through flue 62.

Therefore, the device of this invention provides a safe and efficient heating means for homes which is light in weight and relatively uncomplicated to install. Because the device is a zero clearance unit, no masonry construction to serve as a foundation, fire wall, or the like, is necessary, and therefore, both the cost and the space requirements for utilization of this device are minimized.

In conclusion, then the device of this invention provides a zero clearance fireplace heating unit which utilizes glass doors to cover the front of the firebox, and supplies combustion air from, preferably, the outside which air is circulated through a labyrinthian series of passageways within the device, a portion of said air being directed into the firebox across the inner surface of the glass doors, and the remaining portion thereof being directed into the room to form convection currents within the room. In an alternative embodiment, room air is circulated around the firebox and returned to the room to form convection currents while outside air is circulated around the firebox and into the firebox as combustion air.

The invention hereinabove described resides in a zero clearance fireplace heating unit for heating a room comprising: a firebox in communication through a hood portion thereof with a flue, said firebox having a front opening and glass doors mounted thereon to cover said opening; a plurality of chambers defined by heat conducting walls surrounding the bottom, sides and rear of said firebox; first means for directing a flow of air through said chambers to heat said air when fuel is consumed in said firebox and cool said walls; second means for directing heated air from one of said chambers into said firebox and across the interior surfaces of said doors when said doors are closed to furnish combustion air within said firebox; and third means for directing heated air from one of said chambers into said room.

While a specific embodiment of the invention has been shown and described in detail, it will be understood that the invention may be modified without departing from the spirit of the invention principles as set forth in the hereafter appended claims.

It is claimed:

1. A zero clearance fireplace heating unit for heating a room comprising:

a firebox defined by heat conducting walls and a floor; a hood integral with the upper portion thereof, said hood in communication with a flue so that products of combustion in said firebox are collected in the hood and conveyed therethrough to the flue; the firebox having a front access opening and glass doors mounted thereon to cover said opening so that when said doors are closed air will not be admitted to said firebox through said opening;

first, second and third successive chambers defined by mutually spaced heat conducting walls, said chambers surrounding, respectively, the bottom, sides and rear of said firebox, the first chamber, and the second chamber;

first means including an inlet for communicating with the exterior of the room for introducing outside air into the third chamber, and for directing a flow of outside air successively through the third, second, and first chambers in heat exchange relationship with said walls and the outside surface of said firebox;

second means for directing heated air from said first chamber into said firebox and across the interior surface of said doors when said doors are closed to furnish combustion air within said firebox; and third means for directing heated air from said first chamber into said room.

2. The device of claim 1 wherein said first means further includes an alternate inlet communicative with the interior of said room and means for introducing room air into the third chamber for circulation through said device.

3. The device of claim 2 further comprising a room air inlet and an outside air inlet through the bottom portion of said third chamber; means carried by said device for opening and closing said inlets.

4. The device of claim 3 wherein said inlets are disposed in the base of said chamber below the bottom of said firebox.

5. The device of claim 1 wherein said first means further comprises means for directing said flow of air upwardly through the third chamber, downwardly through the second chamber and subsequently upwardly through the first chamber.

6. The device of claim 1 further comprising a fourth chamber surrounding said third chamber.

* * * * *